US006265086B1

(12) United States Patent
Harkness

(10) Patent No.: US 6,265,086 B1
(45) Date of Patent: Jul. 24, 2001

(54) ELECTROLESS METAL DEPOSITION ON SILYL HYDRIDE FUNCTIONAL RESIN

(75) Inventor: Brian Harkness, Midland, MI (US)

(73) Assignee: Dow Corning Limited, Barry Wales (GB)

( * ) Notice: Subject to any disclaimer, the term of this patent is extended or adjusted under 35 U.S.C. 154(b) by 0 days.

(21) Appl. No.: 09/328,086

(22) Filed: Jun. 8, 1999

(30) Foreign Application Priority Data

Oct. 6, 1998 (GB) ..... 9812425

(51) Int. Cl.[7] ..... B32B 15/08
(52) U.S. Cl. ..... 428/626; 428/936; 427/304
(58) Field of Search ..... 428/626, 936; 427/304

(56) References Cited

U.S. PATENT DOCUMENTS

| | | | |
|---|---|---|---|
| 3,615,272 | 10/1971 | Collins | 23/366 |
| 4,999,397 | 3/1991 | Weiss | 524/755 |
| 5,010,159 | 4/1991 | Bank | 528/23 |
| 5,079,600 | 1/1992 | Schnur et al. . | |
| 5,238,787 | 8/1993 | Haluska | 430/325 |
| 5,281,440 | 1/1994 | Fry | 427/299 |
| 5,925,415 * | 6/1999 | Fry et al. | 427/304 |

FOREIGN PATENT DOCUMENTS

| | | |
|---|---|---|
| 0647729A1 | 12/1995 | (EP) . |
| 0 725 106 A2 | 7/1996 | (EP) . |
| 0 798 341 A1 | 1/1997 | (EP) . |
| 0 799 858 A1 | 8/1997 | (EP) . |
| 60086017 | 10/1983 | (JP) . |
| 63107122 | 10/1986 | (JP) . |
| WO 97/46326 | 12/1997 | (WO) . |

OTHER PUBLICATIONS

Industrial and Engineering Chemistry, vol. 44, No. 2, pp. 321–326.

Journal of the American Chemical Society, vol. 80, 1958, Oct.–Dec., pp. 5083–5085.

* cited by examiner

*Primary Examiner*—Francis J. Lorin
(74) *Attorney, Agent, or Firm*—Roger E. Gobrogge; Sharon K. Severance

(57) ABSTRACT

A method for selective electroless metal deposition on a substrate. The method comprises applying a patterned coating comprising a silyl hydride functional resin onto a substrate. An electroless plating solution comprising a metal ion is then applied onto the silyl hydride functional resin coating to deposit a patterned metal film on the substrate. The process of the invention is especially useful in the electronics industry.

15 Claims, No Drawings

ELECTROLESS METAL DEPOSITION ON SILYL HYDRIDE FUNCTIONAL RESIN

The present invention relates to a method for electroless metal deposition. Specifically, the method relates to electroless deposition of metal on a substrate having a silyl hydride functional resin coating.

Electroless plating of metals is known in the art. In this process, a metal compound is reduced to metallic state by means of a chemical reducing agent. A typical electroless plating process involves forming a plating solution of a metal salt of the metal to be plated, a suitable reducing agent, a base, a complexing agent to solubilize the metal salt and special additives to control the solution stability and plating rate. These solutions are deposited on a substrate with a catalytically active surface. This catalytically active surface catalyzes the reduction of the metal salt and results in the deposition of the metal as a film on the surface. The metal film is autocatalytic and, thus, catalyzes further reaction and deposition of additional metal.

Anderson, J. Am. Chem. Soc., 80, 5083 (1958), teaches that a silyl hydride functionality can be used as a single electron donor for the reduction of several transition metal halides to their ground metal state. The reference teaches the use of a silane as the source of the silyl hydride functionality.

Similarly, Frye et al. in U.S. Pat. No. 5,281,440 and WO 97/46326 teach a method of depositing a metal film on the surface of a solid which contains hydroxyl groups. The method described therein comprises first reacting the surface of the solid having hydroxyl groups with a silyl hydride such as a silane to form silyl hydride on the surface. Next, the silyl hydride surface is reacted with a metal ion resulting in its reduction and, thus, deposition as a metal film.

The process of the above Frye et. al. patents, however, starts with a surface which contains sufficient hydroxyl groups and these hydroxyl groups are then silylated by reaction with a silane. This limits the surfaces onto which the metal film can be applied. Moreover, this process is complicated, time consuming, expensive and it can result in the release of byproducts such as HCl. Finally, the process generally cannot provide metal tracks with high resolution.

Wagner et al., Industrial and Engineering Chemistry, vol. 44, no. 2, pp. 321 (1952) teach the production, properties and uses for silicon oxyhydride. The reference states that solutions of silicon oxyhydride can be used as reducing agents for the reduction of various metals. Likewise the reference states that silica coated with silicon oxyhydride by a process comprising hydrolyzing trichlorosilane on its surface can reduce silver and other ions. The reference does not, however, teach either applying resinous coatings from solutions which act as reducing agents for metals or forming patterned metal films on substrates.

We have now discovered a process for electroless metal deposition which avoids the problems of the prior art processes.

The present invention provides in one of its aspects a method for forming a patterned metal film on a substrate by electroless metal deposition comprising applying a patterned coating comprising a silyl hydride functional resin onto a substrate and applying an electroless plating solution comprising a metal ion onto the silyl hydride functional resin coating to deposit a patterned metal film on the substrate.

By the above method, one can apply metal films on a wide variety of substrates by simple processes. The resultant metal films can be formed with very high resolution such that they are useful in the electronics industry.

The choice of substrates to be coated in the present invention is limited only by the fact that the silyl hydride functional resin must adhere to a surface of the substrate without adversely affecting the structure of the resin or the surface of the substrate. Thus, the substrate can be, for example, glass, metal, plastic, ceramic or the like. It is preferred, however, to coat electronic substrates including, but not limited to, electronic devices or electronic circuits such as circuit boards, silicon based devices, gallium arsenide based devices, focal plane arrays, opto-electronic devices, photovoltaic cells and optical devices.

The first step in the electroless deposition of metals according to this invention comprises the activation of the substrate surface by deposition of the silyl hydride functional resin. The resin coating can be on one or more surfaces of the substrate.

The silyl hydride (Si—H) functional resin used herein can be any resin which is capable of being applied to the surface of the substrate and provide sufficient Si—H functionality at its surface to generate an effective catalytic coating for the electroless metal deposition. The structure of the resin is not specifically limited. Such resins are known in the art but have not been used for the purpose of the present invention. Generally, they have units of the structure:

$$R_pHSiO_{(3-p)/2}$$

in which each R is independently an organic group or a substituted organic group, preferably a monovalent hydrocarbon group containing 1 to 20 carbon atoms such as alkyl (e.g., methyl, ethyl, propyl or butyl), alkenyl or phenyl and p is 0, 1, or 2. Such resins may also contain units of the structure:

$$R_nSiO_{(4-n)/2}$$

in which R is as referred to above, and n is 0, 1, 2 or 3. Obviously, such resins must have sufficient crosslinking (i.e., units in which silicon is bonded to 3 or 4 oxygen atoms) to be resinous in structure.

The preferred silyl hydride functional resins contain units of the formula:

$$HSiO_{3/2}$$

These resins may be only partially hydrolyzed (i.e., containing some Si—OR' in which R' is an organic group or a substituted organic group (including, for example, alkyls such as methyl, ethyl, propyl, butyl, etc., aryls such as phenyl, and alkenyls such as allyl or vinyl) which, when bonded to silicon through the oxygen atom, forms a hydrolyzable substituent) and/or partially condensed (i.e., containing some Si—OH). Although not represented by this structure, these resins may contain a small number (e.g., less than about 10%) of silicon atoms which have either 0 or 2 hydrogen atoms attached thereto due to various factors involved in their formation or handling.

The most preferred silyl hydride functional resins are those which are substantially hydrolyzed and condensed and have the structure $(HSiO_{3/2})_n$ in which n is 3 to 10,000. These materials, known as hydrogen silsesquioxane resins, and methods for their production are known in the art. For example, Collins et al. in U.S. Pat. No. 3,615,272 teach the production of a nearly fully condensed resin (which may contain up to 100–300 ppm silanol) by a process comprising hydrolyzing trichlorosilane in a benzenesulfonic acid hydrate hydrolysis medium and then washing the resultant resin with water or aqueous sulfuric acid. Similarly, Bank et al. in U.S. Pat. No. 5,010,159 teach hydrolyzing hydridosilanes in an arylsulfonic acid hydrate hydrolysis medium to form a resin which is then contacted with a neutralizing agent. The structure of the hydrogen silsesquioxane resin may be what is generally known as ladder-type, cage-type or mixtures thereof.

Other silyl hydride functional resins, such as those described by Frye et al. in U.S. Pat. No. 4,999,397, those produced by hydrolyzing an alkoxy or acyloxy silane in an acidic, alcoholic hydrolysis medium, those described in 60-86017 and 63-107122, or any other silyl hydride functional resin, will also function herein.

The silyl hydride functional resin is applied as a coating to a surface of the substrate. The silyl hydride functional resin coating can be applied in any manner desired or practical. A preferred method involves dissolving or dispersing the resin in a diluent to form a mixture. This mixture is then applied to the surface of the substrate.

As such, a second aspect of the present invention is a method for forming a metal film on a substrate by electroless metal deposition comprising applying a mixture comprising a silyl hydride functional resin and a diluent onto a substrate and allowing the diluent to evaporate to form a coating comprising a silyl hydride functional resin and applying an electroless plating solution comprising a metal ion onto the silyl hydride functional resin coating to deposit a metal film on the substrate. The silyl hydride functional resin coating in this aspect of the invention can be patterned or unpatterned.

Diluents which may be used in this aspect of the invention include any agent or mixture of agents which will dissolve or disperse the silyl hydride functional resin to form a liquid mixture without adversely affecting the resin or the resultant coating. These diluents can include, for example, aromatic hydrocarbons such as benzene, xylene or toluene, alkanes such as n-heptane or dodecane, ketones, esters, ethers, or dimethylpolysiloxanes, in an amount sufficient to dissolve/disperse the silyl functional hydride resin to the concentration desired for application. Generally, enough of the above diluent is used to form a 0.1–80 weight percent mixture, preferably 1–50 wt. percent.

The mixture comprising the silyl hydride functional resin and diluent is then coated onto the surface of the substrate. The method of coating can be, but is not limited to, spin coating, dip coating, spray coating or flow coating. Other coating techniques such as silk-screening for selective deposition (e.g., for traces), however, are also deemed to be within the scope of this invention.

The diluent is then allowed to evaporate from the coated substrate resulting in the deposition of the silyl hydride functional resin coating. Any suitable means of evaporation may be used such as simple air drying by exposure to an ambient environment or by the application of a vacuum or mild heat (e.g., less than 50° C.). It is to be noted that when spin coating is used, the additional drying period is minimized as the spinning often drives off the solvent.

Although the above described methods primarily focus on using a diluent facilitated approach, one skilled in the art would recognize that other equivalent means (e.g., melt coating) would also function herein and are contemplated to be within the scope of this invention.

Typically, sufficient silyl hydride functional resin is applied to the surface of the substrate to produce a coating which has sufficient Si-H functionality at its surface to generate an effective catalytic coating for the electroless metal deposition. Generally, sufficient silyl hydride functional resin is used to produce a coating having a thickness in the range of about 0.01 to about 10 micrometers, preferably in the range of about 0.05 to 2 micrometers.

If desired, other optional components may also be included in the above composition comprising the silyl hydride functional resin and optional diluent. These include, for example, catalysts (e.g., Pt, Rh or Cu) or fillers such as oxides, nitrides, borides or carbides of various metals and non-metals (e.g., glass, alumina, silica), calcium carbonate, silicates, pigments, phosphors, metals, and the like. Also, some organic materials such as cellulose, polyamides, phenol resins and the like may also be used.

One particularly advantageous optional component is a photocure additive which can be used in either positive or negative resist techniques to form patterns of the silyl hydride functional resin on the substrate. Such materials and methods for their use are known in the art. Preferred are negative resist materials as exemplified by U.S. Pat. No. 5,238,787, EP725,106, EP798341 and EP799858. Such materials include, for example, N-methylnifedipine, benzyl carbonates, benzoin carbamates, peroxides, benzophenones, acetophenones, silanes and the like. The process used with these negative resist materials generally comprises mixing the silyl hydride functional resin with the photocure additive, applying the mixture as a coating on the substrate, irradiating a pattern on the coating with, for example, a radiation source and a mask, wherein the radiation source causes crosslinking of the irradiated resin, and then rinsing off the non-radiated (non-crosslinked) resin with a solvent or diluent (i.e., development). This process allows for the formation of extremely fine tracks on the substrate which are useful, for instance, in the electronic industry. Similarly, positive resist techniques are also known in the art.

Typically, if photocure additives are used, they are used in an amount which, upon exposure to radiation, produces sufficient cross-linking in the silyl hydride functional resin to prevent its removal during development. Generally, photocure additives are used in an amount of between about 0.01 and 10 weight percent based on the weight of the resin.

If desired, the silyl hydride functional resin coating may be rendered insoluble in solvents to inhibit damage to, or removal of, the resin coating during the electroless plating process (e.g., the solvents in the electroless plating process may damage the resin coating). This can be accomplished by, for example, heating the silyl hydride functional resin coating to cause partial curing. Alternatively, special cure additives such as photobase generators can be incorporated in the resin followed by activation with radiation to partially cure the resin coating.

If the silyl hydride functional resin coating is heated, this can be accomplished at any temperature and in any environment desired provided the silyl hydride functionality remains. Generally, such temperatures are in the range of about 50 to about 500° C. depending on the heating atmosphere (e.g., air, $O_2$, an inert gas ($N_2$, etc.), $H_2$ etc.) and heating technique (e.g., convection oven, rapid thermal processing, hot plate, radiant or microwave energy, etc.). Heating is generally conducted for several seconds up to several hours (e.g., 2 seconds to 3 hours) and the rate of heating is not critical but, it is most practical and preferred to heat as rapidly as possible. Other techniques such as radiation may also be used herein.

In another embodiment of the invention, the coating of the silyl hydride functional resin can be patterned after its deposition. This can be done with resist materials and by methods known in the art. Such resists include, for example, OMR-83™ resist (a bisazido containing rubber) produced by Tokyo Ohka Kogyo.

In yet another embodiment of the invention, the coating of the silyl hydride functional resin can be coated with resist materials by methods known in the art followed by removing a portion of the resist to expose the silyl hydride functional resin for electroless plating as described below. Such resists include, for example, OMR-83™ resist (a bisazido containing rubber) produced by Tokyo Ohka Kogyo. Generally, such a method comprises applying the silyl hydride functional resin coating, applying the resist, irradiating the resist and developing the resist by washing off the non-irradiated resist to expose the silyl hydride functional resin.

The electroless plating solutions can then be applied to the silyl hydride functional coating. Preferably, however, the silyl hydride functional coating is first coated with a 'seed', layer of metal. This 'seed' layer is used as the catalyst for further electroless metallization of the surface. Generally, the 'seed' layer is deposited by coating the silyl hydride functional resin coating with a 'seeding' solution. Such solutions generally comprise at least a metal ion. Such metal ions are reduced by the silyl hydride functionality and, thus, the metal is deposited as a film on the substrate. Suitable metals include palladium, tin, rhodium, gold, silver, platinum, cobalt, zinc, titanium, mercury, copper, iron, tantalum, zinc, nickel, cobalt, lead, uranium, bismuth, osmium, ruthenium, antimony, chromium, mixtures and alloys of the above and the like. Preferred for the 'seed' layer is palladium.

Suitable sources of metal ions include salts of the metals. These include, for example, palladium chloride, palladium acetate, copper sulfate, copper nitrate, copper chloride, copper bromide, silver nitrate, silver sulfate, mercury bromide, vanadium chloride, platinum chloride, gold cyanide, and the like. Typically, the metal salts are present in the 'seeding' solution at concentrations in the range of about 0.001 to about 10 weight percent based on the weight of the seeding solution.

The 'seeding' solutions also often contain solvents for the metal salt and any other additives which may be useful or depositing the 'seed' layer of metal such as, for example, other agents used in the electroless plating solutions below.

The solvent can be aqueous or it can be an organic liquid as appropriate for the metal salt. Such organic liquids can include, for example, alcohols, ethers, ketones, alkanes and the like.

The method of applying the 'seeding' solution to the silyl hydride functional resin coating is not critical and can be in any manner practical or desired. This can be, for example, spin coating, dip coating, spray coating or flow coating. For ease of application, it is often preferred to immerse the substrate having the silyl hydride functional resin coating in the 'seeding' solution. It is also often desirable to heat the 'seeding' solution for more rapid deposition of the 'seed' metal layer on the silyl hydride functional resin coating. This can be, for example, at temperatures of 30 to 200° C. Deposition can take from several seconds (e.g., 2–10) up to many hours (e.g., 48 hours) depending on the reaction kinetics and the desired film thickness. Preferably, the reaction will occur in from about 15 seconds up to 3 hours.

After deposition, the substrate can optionally be washed to quench the 'seed' layer deposition process. Any suitable washing solution can be used for this step, but generally it comprises the diluent for the metal salt.

If desired, the 'seed' metal layer can be heated to increase its attachment to the substrate and stabilize the underlying resin coating to the electroless plating solution. This is typically used, for instance, where a highly alkaline electroless plating solution can damage the resin coating. Heating can be performed, for instance, at temperatures of 50 to 500° C. for 5 minutes to several hours (e.g., 3 hours).

Typically, sufficient 'seeding' solution is applied to the silyl hydride functional resin to produce a metal layer which is sufficient to catalyze the electroless metallization as described below. Generally, sufficient 'seeding' solution is used to produce a metal layer having a thickness in the range of from about a monatomic layer to about 100 micrometers.

The electroless plating solutions can then be applied to the substrate having the silyl hydride functional resin coating or, if deposited, the 'seed' layer of metal. The plating solutions generally comprise at least metal ions. Such metal ions react with the silyl hydride functionality or in the presence of the seed metal layer, as appropriate, to catalyze the reduction of the metal resulting in the deposition of the plating metal as a film on the substrate. Suitable metals include palladium, tin, rhodium, gold, silver, platinum, cobalt, zinc, titanium, mercury, copper, iron, tantalum, zinc, lead, uranium, nickel, cobalt, chromium, bismuth, osmium, ruthenium, antimony, mixtures and alloys thereof and the like. Preferred are copper, silver, nickel and gold.

Suitable sources of metal ions include salts of the metals. These include, for example, palladium chloride, copper sulfate, copper nitrate, copper chloride, copper bromide, silver nitrate, silver sulfate, mercury bromide, vanadium chloride, platinum chloride, gold cyanide, nickel sulfate, cobalt (II) chloride, cobalt (II) sulfate, and the like. Typically, the metal salts are present in the electroless plating solution at concentrations in the range of about 0.001 to about 10 weight percent based on the eight of the electroless plating solution.

The electroless plating solutions also often contain solvents for the metal salt, suitable reducing agents, bases, complexing agents to solubilize the metal salt and special additives to control the solution stability and plating rate.

The solvent can be aqueous or it can be an organic liquid as appropriate for the metal salt. Such organic liquids can include, for example, alcohols, ethers, ketones, alkanes and the like.

Examples of reducing agents include formaldehyde, hydrazines, aminoboranes such as dimethylamine borane, borohydrides, hypophosphites, dithionites, sugars and the like. Typically, the reducing agents are present in the electroless plating solution at concentrations in the range of about 0.01 to about 10 weight percent based on the weight of the electroless plating solution.

Examples of bases include sodium hydroxide, quaternary ammonium hydroxides such as tetramethylammonium hydroxide, quaternary phosphonium hydroxides and the like. Typically, the bases are present in the electroless plating solution at concentrations in the range of about 0.01 to about 10 weight percent based on the weight of the electroless plating solution.

Examples of complexing agents include ammonium chloride and hydrochloric acid, tartrates, ethylenediaminetetraacetic acid (EDTA) and salts thereof, tetramethylammonium hydroxide, alkanolamines and the like. Typically, the complexing agents are present in the electroless plating solution at concentrations in the range of about 0.01 to about 10 weight percent based on the weight of the electroless plating solution.

Examples of special additives include stabilizers such as mercaptobenzothiazole, thiourea, sulfur compounds, cyanide or ferrocyanide salts, mercury compounds, molybdenum, tungsten, heterocyclic nitrogen compounds, methylbutynol, proprionitrile, molecular oxygen and the like; rate enhancers such as ammonium salts, nitrates, chlorides, chlorates, perchlorates, tartrates, molybdates and tungstates; and other commonly used ingredients such as surfactants, organic acids such as hydroacetic acid, lactic acid, citric acid, malonic acid, malic acid and propionic acid and materials such as sodium acetate, sodium fluoride, sodium pyrophosphate, thallous nitrate, boric acid, hydrochloric acid, glycine, sodium lauryl sulfate, lead (II) ion, sodium carbonate, methyldichlorosilane, sodium citrate, ammonium chloride, ammonium sulfate, sodium succinate and sodium sulfate. Typically, the special additives are present in the electroless plating solution at concentrations in the range of about 0.001 to about 10 weight percent based on the weight of the electroless plating solution.

The method of applying the electroless plating solution to the silyl hydride functional resin coating or 'seed' metal layer, as appropriate, is not critical and can be in any manner practical or desired. This can be, for instance, spin coating, dip coating, spray coating or flow coating. For ease of application, it is often preferred to immerse the substrate having the silyl hydride functional resin coating or the 'seed' metal layer in a solution of the electroless plating solution. It is also often desirable to heat the electroless plating solution for more rapid deposition of the metal film. This can be, for example, at temperatures of 30 to 200° C. Deposition can take from several seconds (e.g., 2–10) up to many hours (e.g., 48 hours) depending on the reaction kinetics and the desired film thickness. Preferably, the reaction will occur in from about 15 seconds up to 3 hours.

If desired, more than one layer of metal film may be applied. Likewise, if more than one layer of metal film is applied, the layers may be the same or different metals.

After deposition, the substrate can optionally be washed to quench the electroless deposition process. Any suitable washing solution can be used for this step, but generally it comprises the diluent for the metal salt.

If desired, the metal film can be heated to increase its attachment to the substrate. Heating can be performed, for instance, at temperatures of 50 to 500° C. for 5 minutes to several hours (e.g., 3 hours).

Typically, sufficient electroless plating solution is applied to form the desired thickness of metal. This can vary over a very wide range such as from a monolayer to several millimeters.

Metal films formed by the method of the present invention are generally of high quality. In addition, the metal films can have high resolution such as down to less than 5 micron features.

The metal films formed by the method of the invention can be used in any industry where metal films on substrates are desired. One particularly preferred application is in the electronics industry where the metal films can be used, for example, as electrical conductors.

The present invention provides in a third aspect, an electronic substrate having a metal film on a surface comprising an electronic substrate having a surface; on the surface of said electronic substrate, a coating comprising a silyl hydride functional resin; and on said coating comprising a silyl hydride functional resin, a metal film.

In order that the invention may become more clear, there now follows examples illustrative of the methods of the invention. Unless indicated, all parts are by weight and all viscosities are at 25° C.

EXAMPLE 1

Deposition of Hydrogen Silsesguioxane Resin Coatings (A) Thin coatings of hydrogen silsesquioxane resin were applied on the surface of silicon wafers by spin coating solutions of FOx$^{(R)}$ 14 (14 wt. hydrogen silsesquioxane resin made by the method of Collins et al. in U.S. Pat. No. 3,615,272 in methylisobutyl ketone) at 800 rpm for 0.6 seconds and 4000 rpm for 10 seconds to give a coating with a thickness of approximately 0.2 micrometers. The coated wafer was then heated to 200° C.

(B) Other silicon wafers were coated with hydrogen silsesquioxane resin by spin coating solutions of FOx$_{(R)}$ 15 (18 wt. hydrogen silsesquioxane resin in methylisobutyl ketone) at 500 rpm for 3 seconds and 1700 rpm for 10 seconds to give coatings with a thickness of approximately 0.5 micrometers. The coated wafer was then heated to 200° C.

(C) Other silicon wafers were coated with hydrogen silsesquioxane resin by spin coating solutions of FOx$^{(R)}$ 16 (22 wt. % hydrogen silsesquioxane resin in methylisobutyl ketone) and 1 wt. N-methylnifedipine (based on the weight of the resin) at 500 rpm for 3 seconds and 3000 rpm for 10 seconds. The coatings were prebaked at 80° C. for 1 minute. The coatings were then irradiated for 8 seconds with no mask (4.8 mW/cm$^2$ at 254 nm). The coatings were then post baked at 80° C. for 1 minute. Finally, the coatings were rinsed with toluene. The resultant coatings were approximately 0.42 micrometers thick.

(D) Silicon wafers with patterned hydrogen silsesquioxane resin coatings were prepared in the same manner as 1(C) except a UV mask was placed between the UV source and the hydrogen silsesquioxane coatings during irradiation to form a pattern. When the coatings were developed (washed) with toluene, 0.42 micrometer thick patterned coatings resulted.

(E) Silicon wafers with hydrogen silsesquioxane resin coatings were prepared by the procedure of 1(C). OMS-83 resist ™ (Tokyo Ohka Kogyo) (60 cp) was then spin coated on the coatings at 500 rpm for 3 seconds and 5500 rpm for 20 seconds. The resultant coating was prebacked at 80° C. for 5 minutes. The coatings were irradiated (4.8 mW/cm$^2$ at 254 nm) for 2 seconds with a mask as in 1 (D). The coatings were post baked at 80° C. for 1 minute. When the coatings were developed with toluene, 0.3 micrometer thick patterned coatings resulted with no damage to the hydrogen silisesquioxane resin coating.

EXAMPLE 2

Preparation of 'Seeding' Solutions and Surface Catalysis

'Seeding' solutions were prepared by mixing the components in the formulations listed in Table 1. These solutions were filtered to remove traces of non-dissolved reagents and dust particles.

These 'seeding' solutions were applied onto each of the hydrogen silsesquioxane coatings prepared in Example 1 (A–E) by immersing the coated silicon wafers into the seeding solutions. The seeding solutions were used at room temperature unless otherwise indicated in Table 1. Following immersion, the samples were washed with either methanol (for methanol based solutions) or water (for water based solutions) and then allowed to dry. The seeding films were then cured by heating to a temperature of 300° C.

The successful deposition of the reduced metal onto the surface of the hydrogen silsesquioxane resin coating was judged qualitatively by the change in color of the surface following immersion into the metal ion solution. The results are summarized in Table 1.

TABLE I

| Solution | Result |
|---|---|
| (A) 0.12 g palladium (II) chloride 100 ml methanol | Generation of a palladium film on the surface in less than 1 minute. |
| (B) 0.15 g palladium (II) chloride<br>0.03 g ammonium chloride<br>2 drops conc. HCl<br>100 ml distilled water | Generation of a palladium film by heating the 'seeding' solution to 90° C. for 10 minutes. |
| (C) 0.005 g disodium tetrachloroplatinate (II)<br>20 ml distilled water | Generation of a platinum film by heating the 'seeding' solution to 90° C. for 10 minutes. |
| (D) 0.6 g silver (I) nitrate<br>50 ml distilled water | Generation of a silver film by heating the 'seeding' solution to 90° C. for 10 minutes. |
| (E) 0.17 g copper (I) chloride<br>1.62 g tetramethylammonium cyanide<br>1 drop ammonium hydroxide<br>50 ml distilled water | No deposition observed. |
| (F) concentrated copper (II) chloride in water<br>excess diammonium tartate<br>1 drop conc. Ammonium hydroxide (pH < 11) | No deposition observed. |
| (G) 0.28 g gold (I) cyanide<br>0.52 g tetramethyl ammonium cyanide<br>6 drops tetramethylammonium hydroxide (25 wt. % in water)<br>50 ml distilled water | No deposition observed |

EXAMPLE 3

Preparation of Electroless Plating Solutions and Plating Process

Electroless plating solutions were prepared by mixing the components in the formulations listed below:

(I) 0.43 g copper (II) sulfate
- 1.73 g diammonium tartate
- 15 ml tetramethylammonium hydroxide (25 wt. % in water)
- 85 ml distilled water
- formaldehyde (37 wt. % solution in water) added at a ratio of 1 part formaldehyde to 60 parts copper solution just before the bath is used.

Formulation used at 30° C.; pH=12.5

(II) 0.62 g copper (II) sulfate
- 3.0 g ethylenediaminetetraacetic acid (EDTA) diammonium salt hydrate
- 23 ml tetramethylammonium hydroxide (25 wt. % in water)
- 77 ml distilled water
- formaldehyde (37 wt. % solution in water) added at a ratio of 1 part formaldehyde to 60 parts copper solution just before the bath is used.

Formulation used at 50° C.; pH=12.5

(III) 0.17 g copper (I) chloride
- 1.62 g tetramethylammonium cyanide
- 1 drop conc. ammonium hydroxide (25 wt. % in water)
- 50 ml distilled water
- 1 ml formaldehyde (37 wt. % solution in water) added just before the bath is used.

Formulation used at 900C; pH=10.5

(IV)
- (i) 0.62 g silver (I) nitrate
  50 ml distilled water
- (ii) 12 ml conc. Ammonium hydroxide containing 2 g D-glucose
  1 g (i) mixed with 1 g (ii) just prior to use.

Formulation used at 40° C.

(V)—0.28 g gold (I) cyanide
- 0.52 g tetramethyl ammonium cyanide
- 6 drops tetramethylammonium hydroxide (25 wt. % in water)
- 50 ml distilled water small amount of formaldehyde added just before use.

Formulation used at 90 ° C.

These solutions were prepared just prior to use to maximize performance. The solutions appeared to be quite stable with no metal plating out up to 3 hours after preparation.

These electroless plating solutions were deposited onto the hydrogen silsesquioxane coatings having the 'seed' metal layers prepared in Example 2 by immersing the resultant silicon wafers into the electroless plating solutions at the temperatures listed above. Heating was provided by a controlled hot water bath. Fresh solutions were used for each plating. Following immersion, the samples were quenched in distilled water, washed with water and then allowed to dry. The results are presented in Table II.

TABLE II

| Seeding Solution | Deposited Metal Copper | Silver | Gold |
|---|---|---|---|
| A | Site specific deposition; High quality with metallic lustre[1] | Slow, site specific deposition, but but no metallic lustre (grainy deposition) | Slight change in colour (to yellow) indicated very slow deposition |
| B | Site specific deposition; Not as fast as samples treated with (A)[2] | Not tested | Not tested |
| C | Very fast, but not site specific[2] | Not tested | Not tested |
| D | Slow and not site specific[2] | Slow, site specific deposition, but no metallic lustre (grainy deposition) | Not tested |

[1] = Copper electroless plating solutions I, II and III
[2] = Copper electroless plating solution I only

EXAMPLE 4

Single Step Silver Deposition on Patterned Hydrogen Silsesquioxane Resin

An electroless plating solutions was prepared by mixing 0.62 g silver (I) nitrate, 50 ml distilled water, 12 ml conc. ammonium hydroxide containing 2 g D-glucose. This solution was prepared just prior to use to maximize performance.

This electroless plating solution was deposited directly onto the hydrogen silsesquioxane coatings prepared in Example 1 (A–E) by immersing the coated silicon wafers into the electroless plating solutions at 40° C. Heating was provided by a controlled hot water bath. Following immersion, the samples were quenched in distilled water, washed with water and then allowed to dry.

A high quality silver film with a metallic lustre and no grainy texture resulted after 30 seconds of immersion.

That which is claimed is:

1. A method for forming a patterned metal film on a substrate by electroless metal deposition comprising:

applying a patterned coating comprising a silyl hydride functional resin onto a substrate and applying an electroless plating solution comprising a metal ion onto the silyl hydride functional resin coating to deposit a patterned metal film on the substrate.

2. The method according to claim 1 wherein the silyl hydride functional resin is hydrogen silsesquioxane resin.

3. The method according to claim 1 wherein the silyl hydride functional resin coating is heated prior to applying the electroless plating solution.

4. The method according to claim 1 wherein the metal ion is derived from a metal salt and the electroless plating solution also comprises one or more materials selected from the group consisting of solvents for the metal salt, reducing agents, bases, complexing agents to solubilize the metal salt, surfactants and additives which control the solution stability and plating rate of the solution.

5. The method according to claim 1 wherein the substrate comprises an electronic substrate.

6. The method according to claim 1 wherein a metal seeding solution comprising a metal ion is applied on the silyl hydride functional resin coating to deposit a seed metal layer prior to applying the electroless plating solution.

7. The method according to claim 6 wherein the seed metal layer is heated prior to applying the electroless plating solution.

8. The method according to claim 1 wherein the coating comprising the silyl hydride functional resin is deposited by applying a mixture comprising the silyl hydride functional resin and a diluent and allowing the diluent to evaporate.

9. The method according to claim 8 wherein the silyl hydride functional resin solution also comprises a photocure additive.

10. The method according to claim 1 wherein silyl hydride functional resin coating is patterned with a resist material.

11. The method according to claim 1 wherein the metal ion in the electroless plating solution is selected from the group consisting of palladium, tin, rhodium, gold, silver, platinum, cobalt, zinc, titanium, mercury, copper, iron, tantalum, zinc, lead, uranium, nickel, cobalt, chromium, bismuth, osmium, ruthenium, antimony, and mixtures and alloys thereof.

12. A method for forming a metal film on a substrate by electroless metal deposition comprising:

applying a mixture comprising a silyl hydride functional resin and a diluent onto a substrate and allowing the diluent to evaporate to form a patterned coating comprising a silyl hydride functional resin; and applying an electroless plating solution comprising a metal ion onto the silyl hydride functional resin coating to deposit a metal film on the substrate.

13. A method for forming a metal film on a substrate by electroless metal deposition comprising:

applying a mixture comprising a silyl hydride functional resin and a diluent onto a substrate and allowing the diluent to evaporate to form a patterned coating comprising a silyl hydride functional resin;

applying a metal seeding solution comprising a metal ion on the silyl hydride functional resin coating to deposit a seed metal layer; and applying an electroless plating solution comprising a metal ion onto the seed metal layer to deposit a metal film on the substrate.

14. An electronic substrate having a metal film on a surface comprising:

an electronic substrate having a surface;

on the surface of said electronic substrate, a patterned coating comprising a silyl hydride functional resin; and on said coating comprising a silyl hydride functional resin, a metal film.

15. An electronic substrate having a metal film on a surface comprising:

an electronic substrate having a surface;

on the surface of said electronic substrate, a patterned coating comprising a silyl hydride functional resin;

on said coating comprising a silyl hydride functional resin, a seed metal layer; and on said seed metal layer, a metal film.

* * * * *